US008952281B2

(12) United States Patent
Muto

(10) Patent No.: US 8,952,281 B2
(45) Date of Patent: Feb. 10, 2015

(54) SLIDE SWITCH DEVICE

(75) Inventor: Shinya Muto, Miyagi-ken (JP)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 129 days.

(21) Appl. No.: 13/611,716

(22) Filed: Sep. 12, 2012

(65) Prior Publication Data

US 2013/0068598 A1 Mar. 21, 2013

(30) Foreign Application Priority Data

Sep. 16, 2011 (JP) ..... 2011-203157

(51) Int. Cl.
*H01H 3/00* (2006.01)
*H01H 13/00* (2006.01)
*H01H 25/00* (2006.01)

(52) U.S. Cl.
CPC ..... *H01H 25/002* (2013.01); *H01H 2300/008* (2013.01)
USPC ..... 200/329

(58) Field of Classification Search
CPC ..... H01H 1/36; H01H 13/76; H01H 3/04; H01H 15/02; H01H 25/00; H01H 13/70; H01H 15/10; H01H 9/04; H01H 15/00; H01H 2003/008; H01H 2215/00; H01H 2221/014; H01H 2300/008; H02B 1/26
USPC ..... 200/5 R, 547, 548, 551, 17 R, 18, 5 EA, 200/521, 5 EB, 176, 329, 520, 241, 252, 200/293, 302.1–302.3, 304, 333, 345
See application file for complete search history.

(56) References Cited

U.S. PATENT DOCUMENTS

| | | | | |
|---|---|---|---|---|
| 4,454,391 | A * | 6/1984 | Olsson | 200/16 D |
| 8,471,158 | B2 * | 6/2013 | Salagean | 200/5 A |
| 2009/0223798 | A1 | 9/2009 | Miwa et al. | |
| 2010/0258424 | A1 | 10/2010 | Ui et al. | |

FOREIGN PATENT DOCUMENTS

| | | |
|---|---|---|
| EP | 0 530 509 | 3/1993 |
| JP | 2010-251028 | 11/2010 |

OTHER PUBLICATIONS

Extended European Search Report from corresponding European Application No. 12182776.0.4 mailed Dec. 12, 2012.

* cited by examiner

*Primary Examiner* — Edwin A. Leon
*Assistant Examiner* — Anthony R. Jimenez
(74) *Attorney, Agent, or Firm* — Crowell & Moring LLP

(57) ABSTRACT

In a slide switch device in which a tactile-feel generation portion generates a tactile feel when a slider is operated to slide via an operation knob, the tactile-feel generation portion includes cam portions formed at a back surface of a flat plate portion of the slider, coil springs held at a guide base, and driving bodies that are elastically urged to the coil springs and are pressed to the cam portions. Elastic arms that elastically contact a guide flat surface of the guide base are provided at the flat plate portion of the slider. The elastic arms and the cam portions are arranged by the same number at positions separated from a shaft portion of the slider.

5 Claims, 11 Drawing Sheets

SLIDE SWITCH DEVICE

CLAIM OF PRIORITY

This application contains subject matter related to and claims the benefit of Japanese Patent Application No. 2011-203157 filed on Sep. 16, 2011, the entire contents of which is incorporated herein by reference.

BACKGROUND OF THE DISCLOSURE

1. Field of the Disclosure

The present disclosure relates to a slide switch device used for a power seat switch etc. that electrically operates a lumber support embedded in a vehicle seat.

2. Description of the Related Art

With a slide switch device used for a power seat switch etc. of an automobile, when a user operates an operation knob of in a desirable direction, a slider that moves in association with the operation knob performs a switching operation on a contact of a switch element, and a tactile feel that is generated by a tactile-feel generation mechanism is fed back to the user. Conventional slide switch devices that include the tactile feel generation mechanism have a tactile-feel adjustment tool that is fitted and fixed to a guide base with a slider mounted, the slider has a shaft portion integrated with an operation knob, a coil spring and a ball are housed and held directly below the shaft portion, and the ball is pressed to a cam groove of the tactile-feel adjustment tool by an elastic force of the coil spring (for example, see Japanese Unexamined Patent Application Publication No. 2010-251028). The slider has a plurality of legs that engage with a driving portion of a switch element, and the legs pinch the tactile-feel adjustment tool in the thickness direction. Accordingly, if the operation knob is operated and the slider slides on the guide base, the ball slides in the cam groove of the tactile-feel adjustment tool and the tactile feel is generated, and rattling of the slider in the thickness direction of the tactile-feel adjustment tool is reduced.

The slide switch device of the related art disclosed in Japanese Unexamined Patent Application Publication No. 2010-251028 reduces rattling of the slider in the thickness direction of the tactile-feel adjustment tool because the plurality of legs provided at the slider pinch the tactile-feel adjustment tool in the thickness direction. However, if the pinching force of the legs is excessively strong, a sliding resistance between the legs and the tactile-feel adjustment tool excessively increases, and the slider cannot be operated to smoothly slide. Hence, the legs have to contact the tactile-feel adjustment tool by a relatively small pinching force. In this case, when the ball at an initial position is pressed to a valley portion of the cam groove, the slider can be held in a state with small rattling. However, when the slider at the initial position is operated to slide and the ball is separated from the valley portion of the cam groove, the slider likely rattles in the sliding direction. In particular, if the slider can be operated to slide in multiple directions including two directions being orthogonal to each other, rattling likely occurs during the sliding operation of the slider. An operation feel may markedly deteriorate.

These and other drawbacks exist.

SUMMARY OF THE DISCLOSURE

Embodiments of the present disclosure provide a slide switch device that restricts rattling of a slider and a good operation feel.

According to an embodiment of the present disclosure, a slide switch device includes a switch element; a slider that performs a switching operation on a contact of the switch element, the slider having a shaft portion, a bottom surface, and corner portions; a guide base that movably supports the slider; a casing that pinches the slider between the casing and the guide base; an operation knob integrated with the shaft portion of the slider, the shaft portion protruding from the casing; and a tactile-feel generation portion having an elastic body interposed between the guide base and the slider, the tactile-feel generation portion generating a tactile feel when the slider is operated to slide via the operation knob. The slider includes an elastic urging portion that is deformed when the elastic urging portion is pressed to the guide base. The elastic urging portion and the tactile-feel generation portion are arranged by the same number at positions separated from the shaft portion.

With such a slide switch device, when the slider is operated to slide in a desirable direction, the slider receives the elastic forces from the elastic urging portion and the tactile-feel generation portion in a well balanced manner and the slider slides on the guide base. Accordingly, rattling of the slider can be restricted and an operation feel can be improved.

Also, the elastic urging portion may be an elastic arm integrally formed with the slider in a cantilevered manner, and the tactile-feel generation portion may include a cam portion formed at the bottom surface of the slider, a coil spring being the elastic body and held at the guide base, and a driving body that is elastically urged to the coil spring and is pressed to the cam portion. Accordingly, the elastic arm being the elastic urging portion and the cam portion being a component of the tactile-feel generation portion can be precisely integrally formed with the slider.

In this case, when two lines having an intersection point at the shaft portion are set in a plane extending in a moving direction of the slider, two of the elastic arms may be formed on one of the lines at equal distances from the intersection point, and two of the cam portions may be formed on the other line at equal distances from the intersection point. Accordingly, the elastic arms and the cam portions can be arranged in a well balanced manner in the limited area of the slider.

Also, the slider may be movable in two directions being orthogonal to each other, and also the two cam portions may be formed in substantially conical recessed surfaces. Accordingly, the slider can be operated to slide smoothly in two different directions from the initial position. A multi-directional slide switch device with a good operation feel can be provided.

Also, the two elastic arms and the two cam portions may be formed at the corner portions of the slider. Accordingly, rattling of the slider can be efficiently restricted.

DETAILED DESCRIPTION OF THE DISCLOSURE

The following description is intended to convey a thorough understanding of the embodiments described by providing a number of specific embodiments and details involving a slide switch device. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Figure 1:
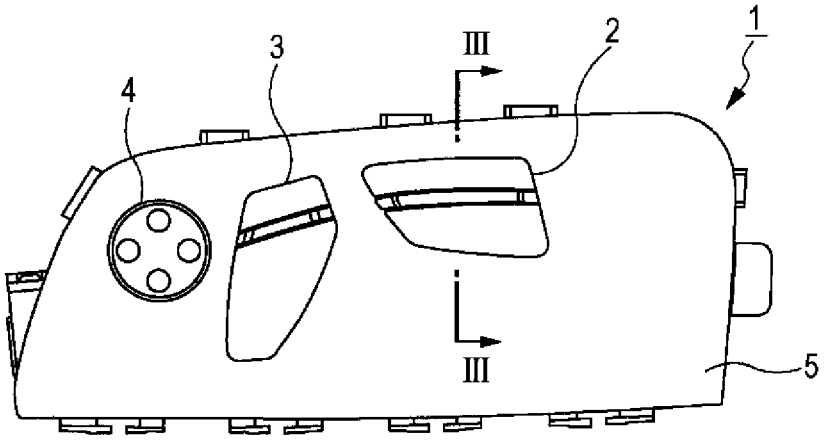
FIG. 1 is plan view of a seat switch unit on which a slide switch device according to an embodiment of the present disclosure is mounted.

A seat switch unit 1 shown in FIG. 1 may operate a lumber support etc. embedded in a vehicle seat, and may be arranged on a side of a sitting part of the vehicle seat. An operation knob 2 for adjusting a front-rear position, a height position, etc., of the seat; an operation knob 3 for reclining adjustment; and an operation knob 4 for adjusting a protruding amount of a hip portion of a backrest may be arranged in line on the upper surface of the seat switch unit 1. A mechanism driven by the operation knob 2 may be a slide switch device according to the various embodiments of the present disclosure. In the following description, the slide switch device is described in detail, and description of switch devices driven by the other operation knobs 3 and 4 is omitted.

Figure 2:
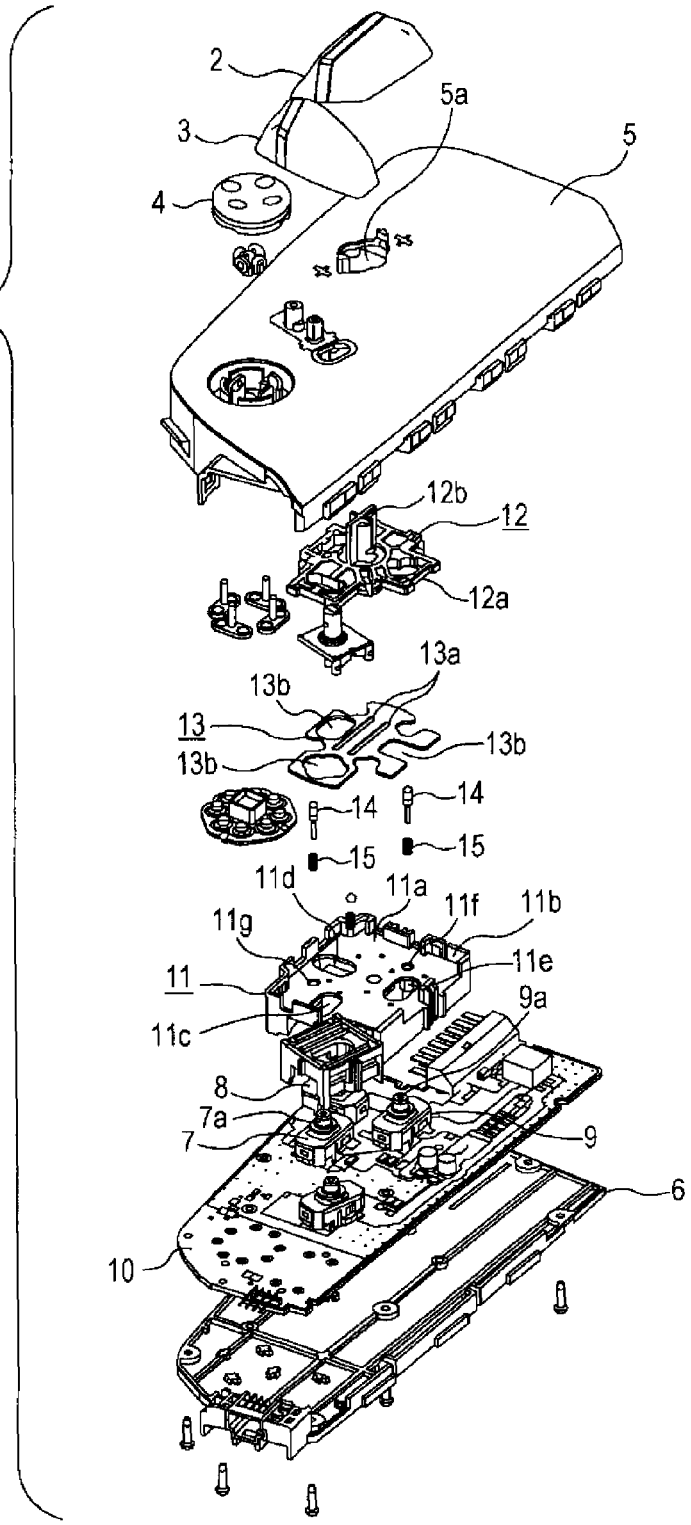
FIG. 2 is an exploded perspective view of the seat switch unit according to an embodiment of the disclosure.

As shown in FIG. 2, the slide switch device according to an embodiment may include a casing 5 having a clearance hole 5*a*, the operation knob 2 arranged on an upper surface of the casing 5, a base body 6 that closes an opening at a lower surface of the casing 5, a circuit board 10 having a plurality of switch elements 7 to 9 etc. mounted thereon, a guide base 11 pinched between the casing 5 and the base body 6, a slider 12 pinched between the casing 5 and the guide base 11, a cam plate 13 engaging with a lower surface of the slider 12, a pair of driving bodies 14, and a pair of coil springs 15 etc.

The casing 5 and the base body 6 may be integrated by means for fixing such as screwing etc., and form an outer case. Components of the switch device except the operation knob 2 may be housed in an inner space defined by the casing 5 and the base body 6.

Figure 3:
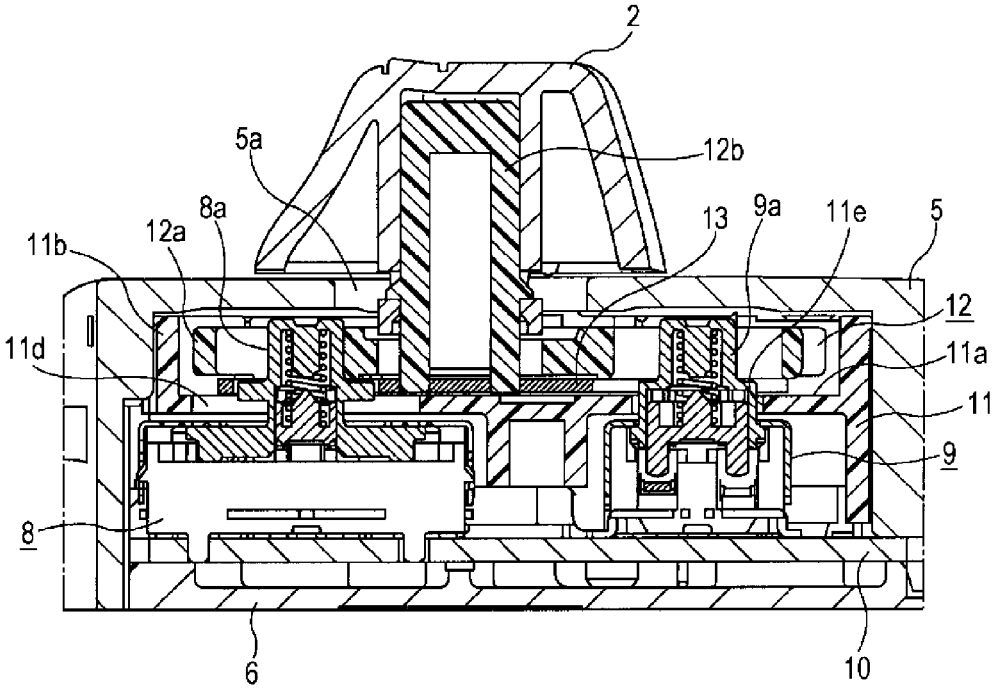
FIG. 3 is a cross-sectional view taken along line III-III in FIG. 1.

The circuit board 10 may be fixed to an upper surface of the base body 6. In addition to the three switch elements 7 to 9 operated by the operation knob 2, other switch elements operated by the operation knobs 3 and 4 may be mounted on the circuit board 10. The switch elements 7, 8, and 9 may be slide switches having stems 7*a*, 8*a*, and 9*a* protruding upward. When the stems 7*a*, 8*a*, and 9*a* are moved in directions orthogonal to the axes of the stems 7*a*, 8*a*, and 9*a*, embedded conductive plates (movable contacts) may move in a seesaw manner, to come into contact with and be separated from fixed contacts (see FIG. 3).

Figure 10:
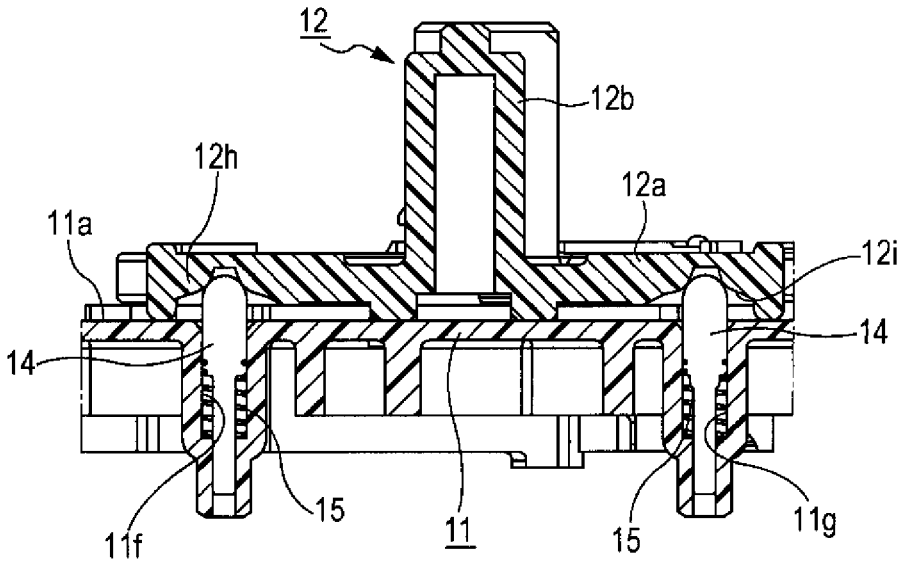
FIG. 10 is a cross-sectional view taken along line X-X in FIG. 9.
Figure 12:
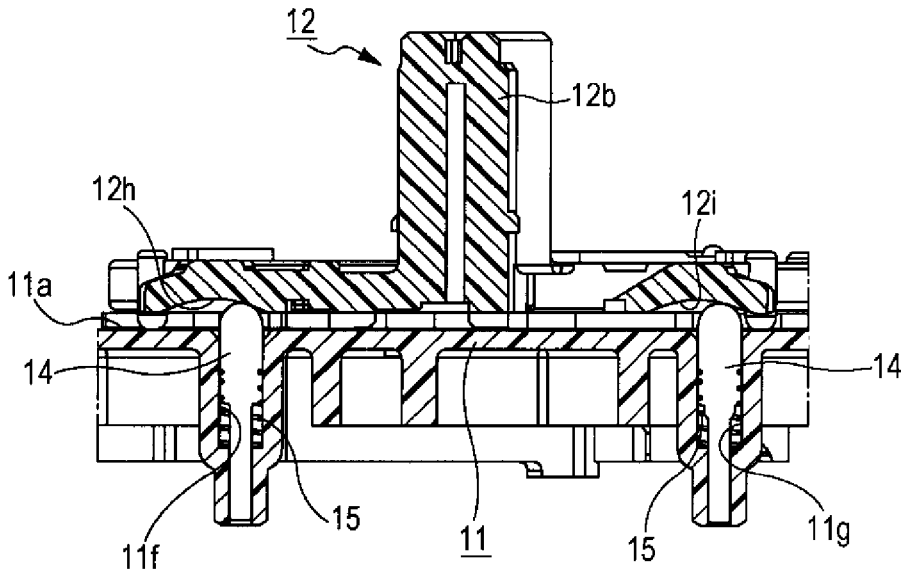
FIG. 12 is a cross-sectional view taken along line XII-XII in FIG. 11.

The guide base 11 may be a molded part made of synthetic resin having high smoothness. As shown in FIG. 2, a restriction wall 11*b* may be formed around a guide flat surface 11*a* having a substantially rectangular shape. The guide flat surface 11*a* may have therein three guide holes 11*c*, 11*d*, and 11*e* having track shapes. The longitudinal direction of the guide hole 11*d*, being one of the three guide holes 11*c*, 11*d*, and 11*e*, may be orthogonal to the longitudinal directions of the remaining two guide holes 11*c* and 11*e*. Also, the guide flat surface 11*a* may have therein two holding holes 11*f* and 11*g*. As shown in FIGS. 10 and 12, the holding holes 11*f* and 11*g* may have stepped shapes. The holding holes 11*f* and 11*g* respectively may house the rod-shaped driving bodies 14 with the coil springs 15 interposed. The driving bodies 14 may be urged to a lower surface of the slider 12 because the driving bodies 14 respectively may receive elastic forces of the corresponding coil springs 15.

The slider 12 may be a molded part made of synthetic resin having good smoothness. As shown in FIGS. 4 to 8, the slider 12 may include a flat plate portion 12*a* extending in the horizontal direction, and a shaft portion 12*b* protruding upward from the flat plate portion 12*a*. The shaft portion 12*b* may be inserted into the clearance hole 5*a* and may protrude to the upper side of the casing 5. The operation knob 2 may be press-fitted to a distal end of the shaft portion 12*b*. Accordingly, the slider 12 and the operation knob 2 may be integrated (see FIG. 3). Two elastic arms 12*c* and 12*d* and three through holes 12*e*, 12*f*, and 12*g* may be formed at the flat plate portion 12*a* of the slider 12. Two cam portions 12*h* and 12*i* and a pair of guide rails 12*j* may be formed at a back surface of the flat plate portion 12*a*.

Figure 5:
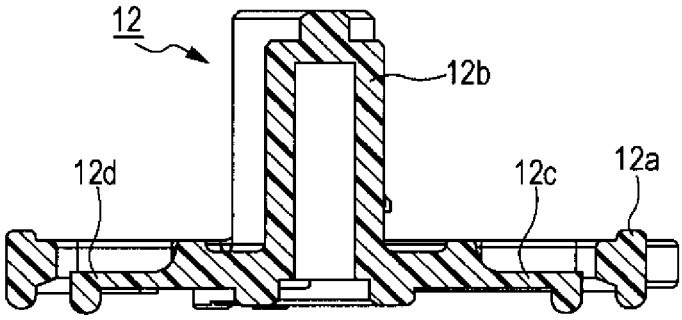
FIG. 5 is a cross-sectional view taken along line V-V in FIG. 4.
Figure 6:
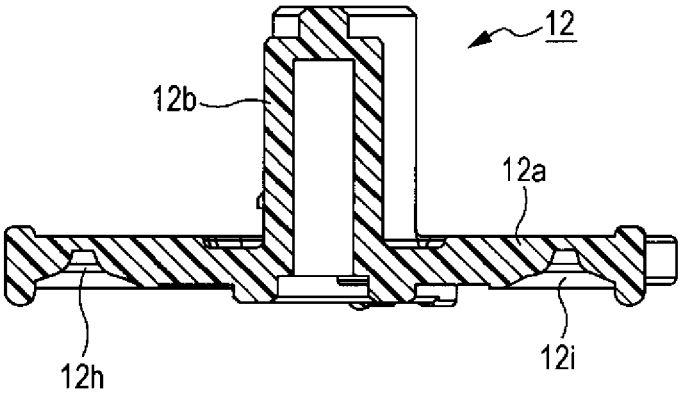
FIG. 6 is a cross-sectional view taken along line VI-VI in FIG. 4.
Figure 7:
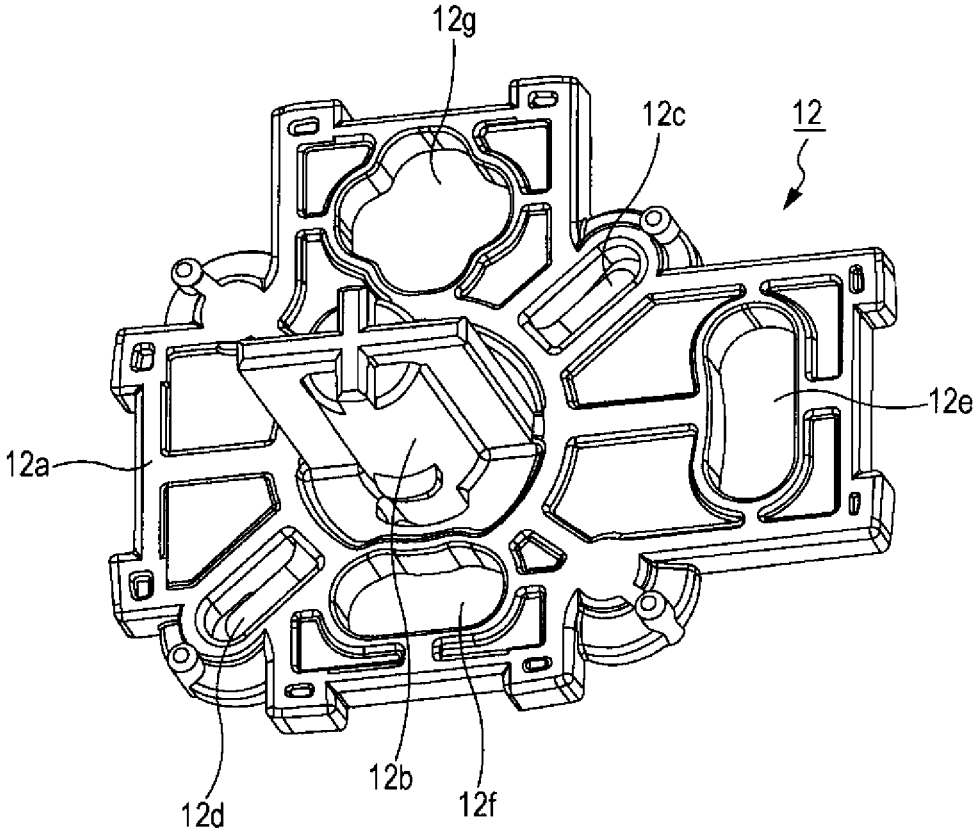
FIG. 7 is a perspective view when viewed from an upper surface of the slider.
Figure 8:
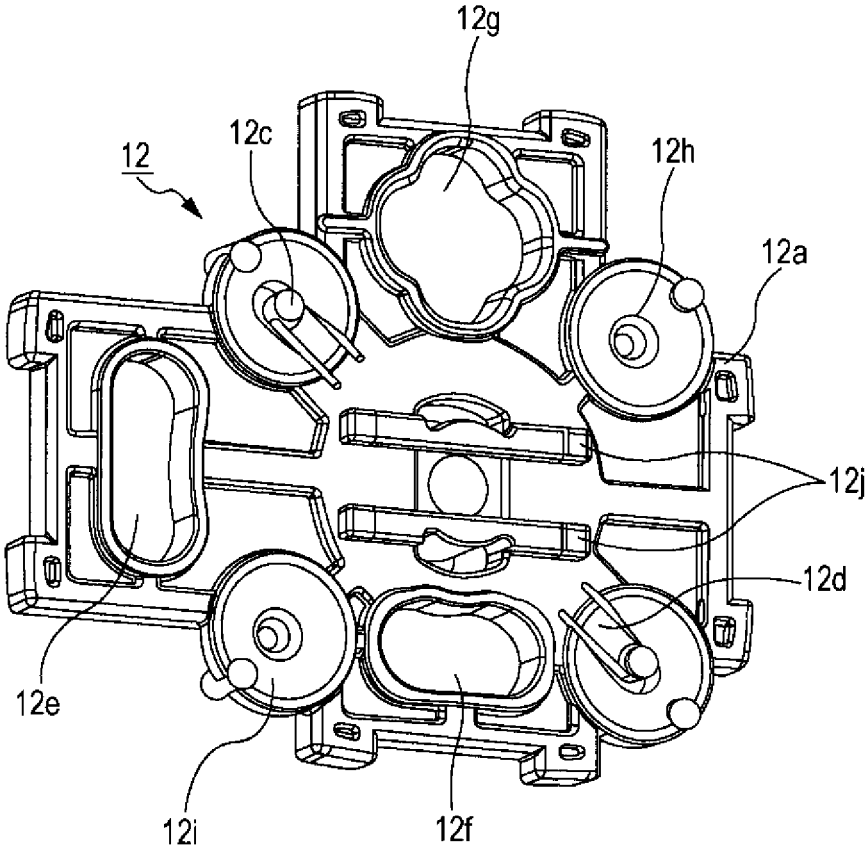
FIG. 8 is a perspective view when viewed from a lower surface of the slider.

As shown in FIG. 5, the elastic arms 12*c* and 12*d* each may be an elastic urging portion that may be integrally formed with the flat plate portion 12*a* in a cantilevered manner. Distal ends (free ends) of the elastic arms 12*c* and 12*d* may be pressed to the guide flat surface 11*a* of the guide base 11, so that the flat plate portion 12*a* of the slider 12 receives elastic forces from the elastic arms 12*c* and 12*d* and may be urged to the lower surface of the casing 5. Also, the cam portions 12*h* and 12*i* may be substantially conically recessed surfaces (dented surfaces) and the lower sides of the cam portions 12*h* and 12*i* may be opened. A boundary portion between a valley portion formed at the center and a conical oblique surface of each of the cam portions 12*h* and 12*i* may have a shape that may generate the above-described tactile feel. The driving bodies 14 urged to the coil springs 15 respectively may be pressed to the cam portions 12*h* and 12*i*. The flat plate portion 12*a* of the slider 12 may be urged to the lower surface of the casing 5 while the flat plate portion 12*a* receives the elastic forces from the coil springs 15 in addition to the elastic forces from the elastic arms 12*c* and 12*d*. Two sets of tactile-feel generation portions may be formed by the cam portions 12*h* and 12*i*, and the corresponding driving bodies 14 and coil springs 15. Although the detail is described later, when the slider 12 is operated to slide in a desirable direction, a tactile feel (a click feel) may be generated from each of the tactile-feel generation portions.

Figure 4:
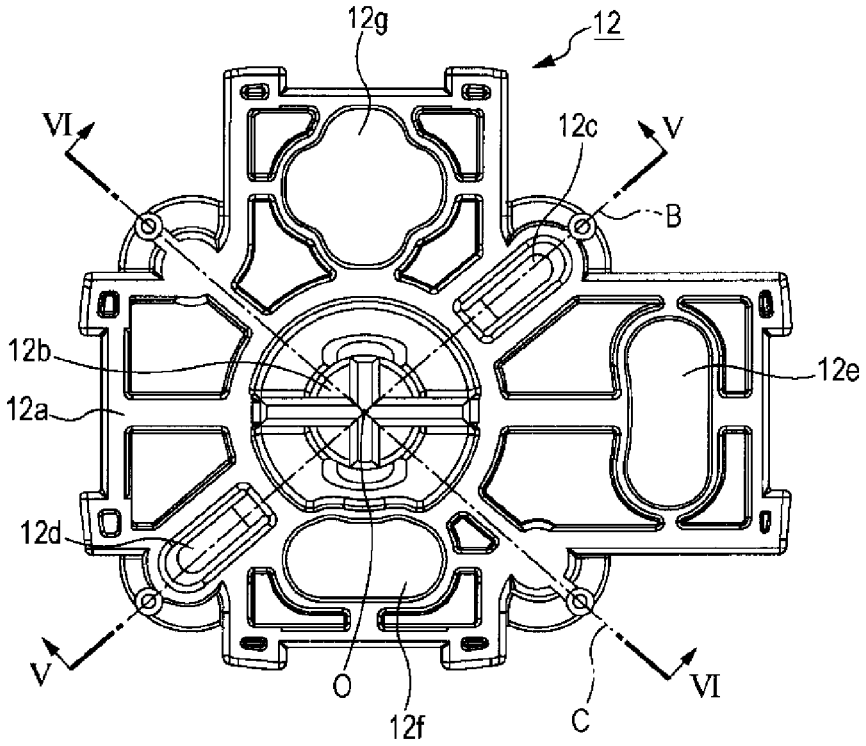
FIG. 4 is a plan view of a slider provided at the slide switch device in FIG. 1.

As shown in FIG. 4, assuming that two lines B and C passing through the center O of the shaft portion 12*b* of the slider 12 and intersecting with each other are set, the elastic arms 12*c* and 12*d* may be arranged on the line B, and the cam portions 12*h* and 12*i* are arranged on the line C. The lines B and C substantially orthogonally intersect with each other. Distal ends of the elastic arms 12*c* and 12*d* and the centers (the valley portions) of the cam portions 12*h* and 12*i* may be alternately arranged at about 90 degrees on concentric circles around the shaft portion 12*b*.

The cam plate 13 may be formed by punching a metal flat seat into a predetermined shape. The cam plate 13 may have a pair of guide grooves 13*a* at the center and three relief portions 13*b* at the periphery. The cam plate 13 may be mounted on the guide flat surface 11*a* of the guide base 11. The guide rails 12*j* formed on the back surface of the flat plate portion 12*a* of the slider 12 respectively may engage with the corresponding guide grooves 13*a* of the cam plate 13. Accordingly, only when the slider 12 is operated to slide in an extending direction of the guide grooves 13*a*, the slider 12 may slide relative to the guide flat surface 11*a* and the cam plate 13. When the slider 12 is operated to slide in other direction, the slider 12 and the cam plate 13 may slide together on the guide flat surface 11*a*. Even if the relative positions of the slider 12 and the cam plate 13 are changed, the cam plate 13 does not overlap the distal ends of the elastic arms 12*c* and 12*d*, or the centers of the cam portions 12*h* and 12*i*.

The above-described stems 7*a*, 8*a*, and 9*a* of the switch elements 7, 8, and 9 respectively may be inserted through the guide holes 11*c*, 11*d*, and 11*e* of the guide base 11 and the relief portions 13*b* of the cam plate 13, and then respectively may be inserted into and engage with the corresponding through holes 12*e*, 12*f*, and 12*g* of the slider 12. Accordingly, when the slider 12 is operated to slide in X1-X2 directions in FIG. 9, only the stem 7*a* engaging with the through hole 12*e* may slide in the same direction accordingly, and may perform a switching operation on the contact of the switch element 7. Also, when the slider 12 is operated to slide in Y1-Y2 directions in FIG. 9, only the stem 8*a* engaging with the through hole 12*f* slides in the same direction accordingly, and in this case, may perform a switching operation on the contact of the switch element 8. Further, when the slider 12 is operated to rotate around the shaft portion 12*b* in normal-reverse rotation directions by a predetermined angle, only the stem 9*a* engaging with the through hole 12*g* slides in the same direction accordingly, and in this case, may perform a switching operation on the contact of the switch element 9.

Figure 9:
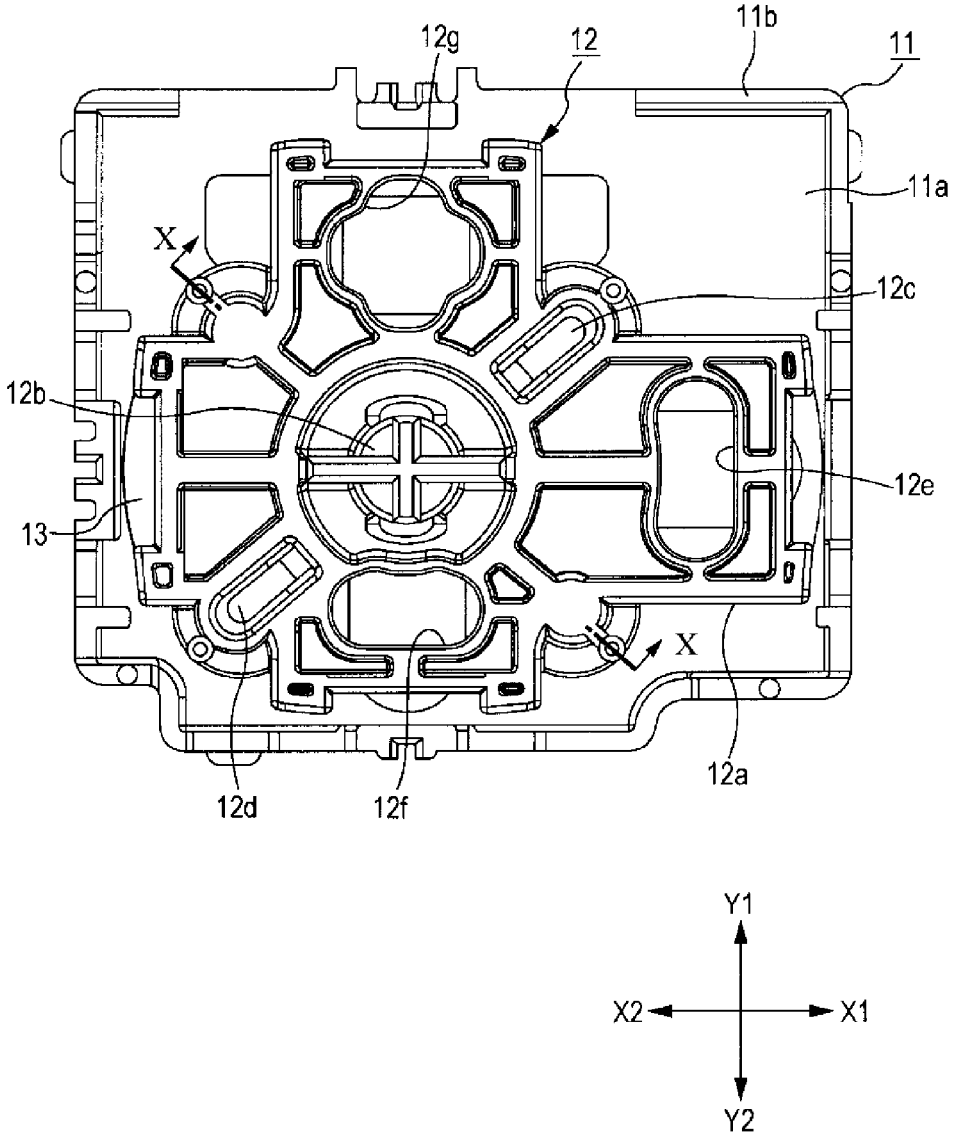
FIG. 9 is a plan view showing a state in which the slider is at an initial position on a guide base.

With such an embodiment of a slide switch device, as shown in FIG. 9, when the slider 12 may be at the initial position on the guide flat surface 11*a* of the guide base 11, the distal ends of the elastic arms 12*c* and 12*d* elastically contact the guide flat surface 11*a*, and the driving bodies 14 respectively may receive the elastic forces from the coil springs 15 and are pressed to the valley portions of the cam portions 12*h* and 12*i* (see FIG. 10). Hence, the flat plate portion 12*a* of the slider 12 may be elastically urged to the lower surface of the casing 5 in a well-balanced manner and may be held in a stable state by the elastic forces from the elastic arms 12*c* and 12*d* being the elastic urging portions, and the elastic forces from the coil springs 15 being the elastic bodies of the tactile-feel generation portions.

Figure 11:
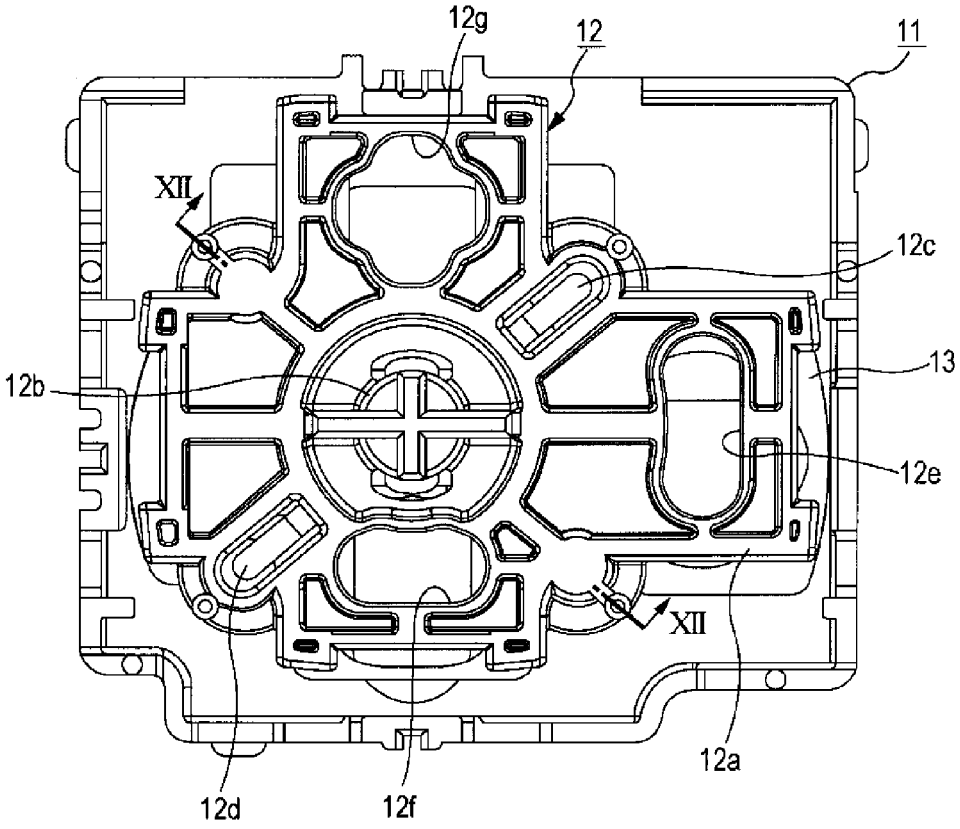
FIG. 11 is a plan view showing a state in which the slider is operated to slide on the guide base.

In this state, if the user operates the slider 12 via the operation knob 2 in a desirable direction, for example, in the Y1 direction in FIG. 9, the slider 12 and the cam plate 13 may slide together on the guide flat surface 11*a* in the same direction. Then, as shown in FIG. 11, the movement of the slider 12 in the same direction may be restricted at a position at which an outer edge of the flat plate portion 12*a* contacts the restriction wall 11*b* of the guide base 11. Meanwhile, since the slider 12 slides on the guide flat surface 11*a* while the slider 12 receives the elastic forces from the elastic arms 12*c* and 12*d* and the coil springs 15, rattling of the slider 12 may be restricted, and a good operation feel can be obtained. Also, when the slider 12 slides from the initial position in a desirable direction in this way, as shown in FIG. 12, the driving bodies 14 respectively may climb over the valley portions of the corresponding cam portions 12*h* and 12*i* and are shifted to the conical oblique surfaces. The tactile feel generated at this time is fed back to the user who manually operates the operation knob 2. When the slider 12 slides in the Y1 direction, the stem 8*a* engaging with the through hole 12*f* may be driven, and may perform a switching operation on the contact of the switch element 8. Hence, for example, the height position of the seat may be adjusted in response to a contact switch signal of the switch element 8.

When the slider 12 is operated to slide in a direction other than the Y1 direction in FIG. 9, the type and switch signal of the switch element 7, 8, or 9 driven in accordance with the sliding operation direction may differ from the above described type and switch signal. For example, when the slider 12 is operated to slide in the Y2 direction in FIG. 9, the stem 8*a* may be driven in a direction opposite to the above-described direction. In this case, the switch element 8 may output another contact switch signal. Also, when the slider 12 is operated to slide in the X1-X2 directions in FIG. 9, the slider 12 may slide relative to the guide flat surface 11*a* and the cam plate 13. In this case, the stem 7*a* engaging with the through hole 12*e* may be driven, and may perform a switching operation on the contact of the switch element 7. Hence, for example, the front-rear position of the seat may be adjusted in response to a contact switch signal of the switch element 7. Further, when the slider 12 is operated to rotate around the shaft portion 12*b* in the normal-reverse rotation directions by a predetermined angle, the slider 12 and the cam plate 13 may rotate together in the same direction on the guide flat surface 11*a* while sliding on the guide flat surface 11*a*. In this case, the stem 9*a* engaging with the through hole 12*g* may be driven and may perform a switching operation on the contact of the switch element 9. Hence, for example, the orientation of the seat may be adjusted in response to a contact switch signal of the switch element 9. Even in any of these cases, since the slider 12 slides on the guide flat surface 11*a* while the slider 12 receives the elastic forces from the elastic arms 12*c* and 12*d* and the coil springs 15, rattling of the slider 12 may be restricted, and a good operation feel can be obtained.

As described above, with the slide switch device according to an exemplary embodiment, the elastic urging portions (the elastic arms 12*c* and 12*d*) that are provided at the slider 12 and elastically contact the guide flat surface 11*a* of the guide base 11, and the tactile-feel generation portions (the cam portion 12*h* and 12*i*, the driving bodies 14, and the coil springs 15) that generate the tactile feel during the sliding operation of the slider 12 may be provided by the same numbers at the positions separated from the shaft portion 12*b* of the slider 12. Accordingly, when the slider 12 is operated to slide in a desirable direction, the slider 12 may slide on the guide flat surface 11*a* while the slider 12 receives the elastic forces from the elastic urging portions and the tactile-feel generation portions in a well balanced manner. Hence, rattling of the slider 12 may be restricted and the operation feel can be improved.

The elastic urging portions may be formed of the elastic arms 12*c* and 12*d* that are integrally formed in a cantilevered manner with the flat plate portion 12*a* of the slider 12; and the tactile-feel generation portions may be formed of the cam portions 12*h* and 12*i* formed at the back surface of the flat plate portion 12*a* of the slider 12, the coil springs (the elastic bodies) 15 held at the holding holes 11*f* and 11*g* of the guide base 11, and the driving bodies 14 that are elastically urged by the coil springs 15 and hence pressed to the cam portions 12*h* and 12*i*. The elastic urging portions (the elastic arms 12*c* and 12*d*) and part of the components of the tactile-feel generation portions (the cam portions 12*h* and 12*i*) can be precisely integrally formed with the slider 12 made of synthetic resin.

Then, when the two lines intersecting with each other at the intersection point O that is the shaft portion 12*b* are set in the plane extending along the moving directions of the slider 12, the two elastic arms 12*c* and 12*d* may be formed on one of the lines at equal distances from the intersection point O, and the two cam portions 12*h* and 12*i* are formed on the other line at equal distances from the intersection point O. Accordingly, the two elastic arms 12*c* and 12*d* and the two cam portions 12*h* and 12*i* can be arranged in a well balanced manner in the limited area of the slider 12. Also, the slider 12 may move in the two directions (the X and Y directions) being orthogonal to each other, and the two cam portions 12*h* and 12*i* are formed in conical shapes. Accordingly, the slider 12 can be operated to smoothly slide in the two different directions from the initial position. A multi-directional slide switch device with a good operation feel can be provided.

Described in the above-described embodiment is the slide switch device in which the slider 12 can move in the two directions being orthogonal to each other (the X and Y directions) and in the rotation direction around the shaft portion 12*b*. However, the slide switch device in which the slider 12 can move only in the two directions being orthogonal to each other (the X and Y directions) or only in one of the X and Y directions may be provided. In this case, the cam plate 13 may be omitted.

Also, in the above-described embodiment, the cam portions 12*h* and 12*i* of the tactile-feel generation portions may be the substantially conical recessed surfaces (the dented surfaces). However, the shapes of the cam portions may be properly changed in accordance with the operation direction of the slider 12. For example, if the slider 12 can move only in the two directions being orthogonal to each other, the cam portion may be a dent with a cross-like shape in plan view. Also, the cam portions 12*h* and 12*i* press the rod-shaped driving bodies 14. However, balls serving as the driving bodies may be pressed to the cam portions 12*h* and 12*i*.

Accordingly, the embodiments of the present inventions are not to be limited in scope by the specific embodiments described herein. Further, although some of the embodiments of the present disclosure have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A slide switch device, comprising:

a switch element having a contact;

a slider that performs a switching operation on the contact of the switch element, the slider having a shaft portion, a bottom surface, and corner portions;

a guide base that movably supports the slider;

a casing that pinches the slider between the casing and the guide base;

an operation knob integrated with the shaft portion of the slider, the shaft portion protruding from the casing; and a tactile-feel generation portion having an elastic body interposed between the guide base and the slider, the tactile-feel generation portion generating a tactile feel when the slider is operated to slide via the operation knob, wherein a portion of the slider is configured as an elastic urging portion that is deformed when the elastic urging portion is pressed to the guide base, and wherein the elastic urging portion and the tactile-feel generation portion are arranged by the same number at positions separated from the shaft portion.

2. The slide switch device according to claim 1, wherein the elastic urging portion is an elastic arm integrally formed with the slider in a cantilevered manner, and wherein the tactile-feel generation portion includes a cam portion formed at the bottom surface of the slider, a coil spring being the elastic body and held at the guide base, and a driving body that is elastically urged to the coil spring and is pressed to the cam portion.

3. The slide switch device according to claim 2, wherein when two lines having an intersection point at the shaft portion are set in a plane extending in a moving direction of the slider, two of the elastic arms are formed on one of the lines at equal distances from the intersection point, and two of the cam portions are formed on the other line at equal distances from the intersection point.

4. The slide switch device according to claim 3, wherein the slider is movable in two directions being orthogonal to each other, and wherein the two cam portions are formed in substantially conical recessed surfaces.

5. The slide switch device according to claim 3, wherein the two elastic arms and the two cam portions are formed at the corner portions of the slider.

* * * * *